United States Patent [19]

Gillam

[11] Patent Number: 4,579,416

[45] Date of Patent: Apr. 1, 1986

[54] ELECTRICAL CONNECTOR

[75] Inventor: Paul T. Gillam, Basingstoke, England

[73] Assignee: Molex Incorporated, Lisle, Ill.

[21] Appl. No.: 644,291

[22] Filed: Aug. 27, 1984

[30] Foreign Application Priority Data

Nov. 16, 1983 [GB] United Kingdom ..... 8330617

[51] Int. Cl.[4] ..... H01R 9/00

[52] U.S. Cl. ..... 339/198 H; 339/59 R; 339/276 SF

[58] Field of Search ..... 339/198 H, 198 R, 198 E, 339/198 G, 198 GA, 46, 59 R, 59 M, 61 R, 61 M, 276 SF, 47 R; 206/330

[56] References Cited

U.S. PATENT DOCUMENTS

| | | | |
|---|---|---|---|
| 848,505 | 3/1907 | Steinberger | 339/198 G |
| 2,928,066 | 3/1960 | Gordon | 339/61 M |
| 3,474,397 | 10/1969 | Piasecki | 339/198 H |
| 4,322,120 | 3/1982 | Rilling | 339/47 R |

FOREIGN PATENT DOCUMENTS

| | | | |
|---|---|---|---|
| 2716700 | 10/1978 | Fed. Rep. of Germany | 339/198 G |

*Primary Examiner*—Gil Weidenfeld
*Assistant Examiner*—Thomas M. Kline
*Attorney, Agent, or Firm*—Louis A. Hecht

[57] ABSTRACT

An arrangement for carrying a continuous sequence of a plurality of similarily oriented connector housing members, connected together side-by-side relationship is disclosed. Each housing member has complementary, interconnecting male and female pivotable coupling members integrally formed at its opposed side faces. A male pivotable coupling member is received within a female pivotable coupling member of an adjacent housing with a snap fit, so as to be journalled therein. Also disclosed is an arrangement for limiting relative rotation between adjacent intercoupled housing members. With the present invention, connector housings can be provided as a continuous chain conveniently transported on reel holders.

6 Claims, 10 Drawing Figures

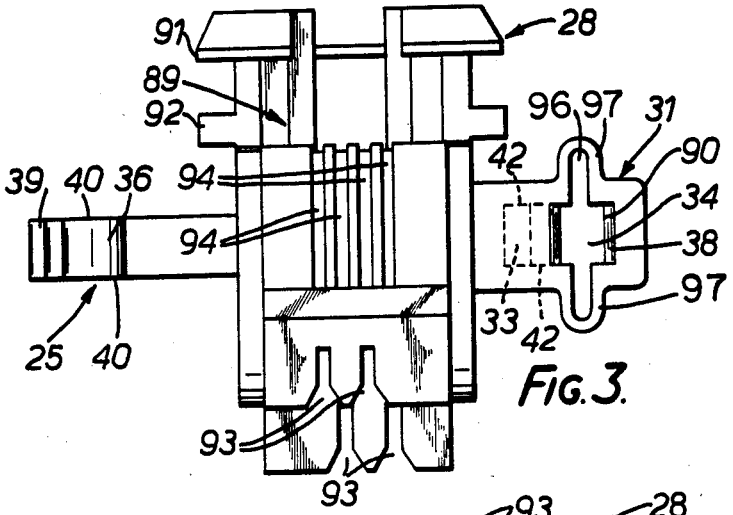
FIG. 3.
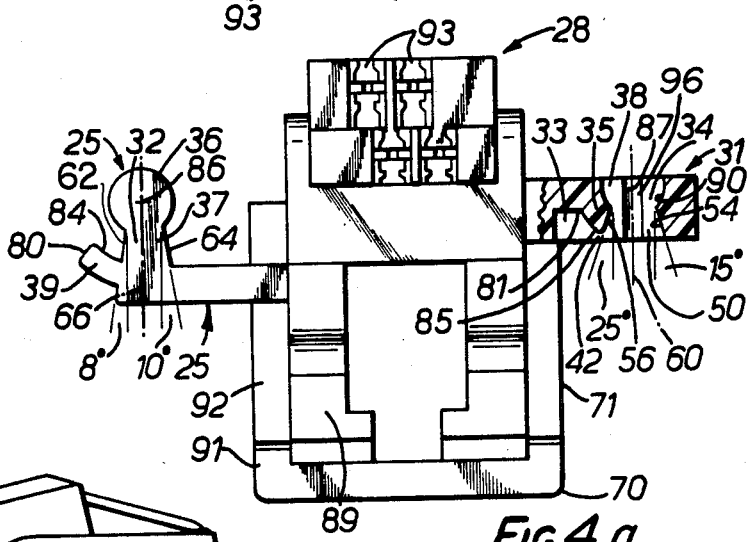
FIG. 4. a.
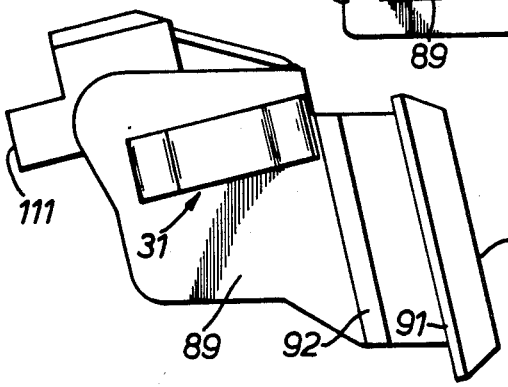
FIG. 5.

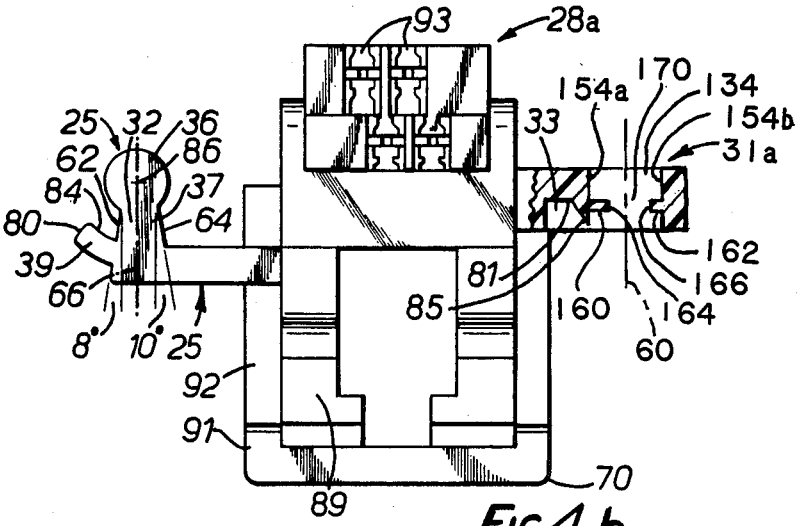
FIG. 4. b.

ELECTRICAL CONNECTOR

BACKGROUND OF THE INVENTION

1. Field of the Invention

This invention relates to electrical connector construction and is generally concerned with facilitating the handling of electrical connectors and electrical connector housings.

2. A Brief Description of the Prior Art

A wide variety of electrical connectors are commercially available for use in the construction of electrically operated equipment and products. Typically, in such applications, electrical signals are conducted between printed circuit board assemblies or components by means of electrical conductors in the form of cable or wiring which, for purposes of manufacturing and maintenance expediency are terminated with electrical connectors.

Such connectors typically comprise a dielectric housing formed by conventional moulding techniques fitted with one or more electrically conductive terminals for providing electrical connection between the cable or wiring and other electircally conductive elements such as printed circuit board and other male terminal pins, plugs and the like components.

Machines are likewise known for assembling terminated wires into connectors to form harnesses and for assembling electrically conductive terminals into dielectric housings to form connectors.

SUMMARY OF THE INVENTION

In order to facilitate the feeding of connectors or connector housings in assembling machines the present invention provides a connector housing having complementary coupling formation on a further one of the housings, thereby to interconnect the housings in line. Preferably, the complementary formations interfit to form articulated joints which interconnect the housings in a chain that may be wound on a reel.

Assembling machines may then be reel fed from such reels with connector housings or connectors, thus further simplifying the machinery, and by supplying connectors or connector housings on reels, the risk of damage during transit of the connectors or housings is reduced and their packaging is facilitated.

It is also preferred that the complementary coupling formations be adapted for snap-fitting, one with the other, so that a line of housings or connectors may be broken and rejoined without loss or damage to any of the parts.

A still further subsidiary feature which may be adopted is that the complementary coupling formations interfit to provide for articulation about substantially a single axis perpendicular to the line of the housings.

This feature ensures that the interconnected housings are predeterminedly orientated with respect to one another in the chain, thus enabling assembling machines to be still further simplified.

BRIEF DESCRIPTION OF THE DRAWINGS

A specific embodiment of the present invention will now be described by way of example, and not by way of limitation, with respect to the accompanying drawings in which:

FIG. 3 is a plan view of a four-position connector housing according to this invention for a socket connector or jack;

FIG. 4*a* is a rear elevation of the housing shown in FIG. 3, in part in cross-section;

FIG. 4*b* is an alternative arrangement of the housing of FIG. 4*a*.

FIG. 5 is a side view of a six-position socket connector of this invention having a housing generally similar to the housing shown in FIG. 3;

DETAILED DESCRIPTION OF THE PREFERRED EMBODIMENT

Figure 1:
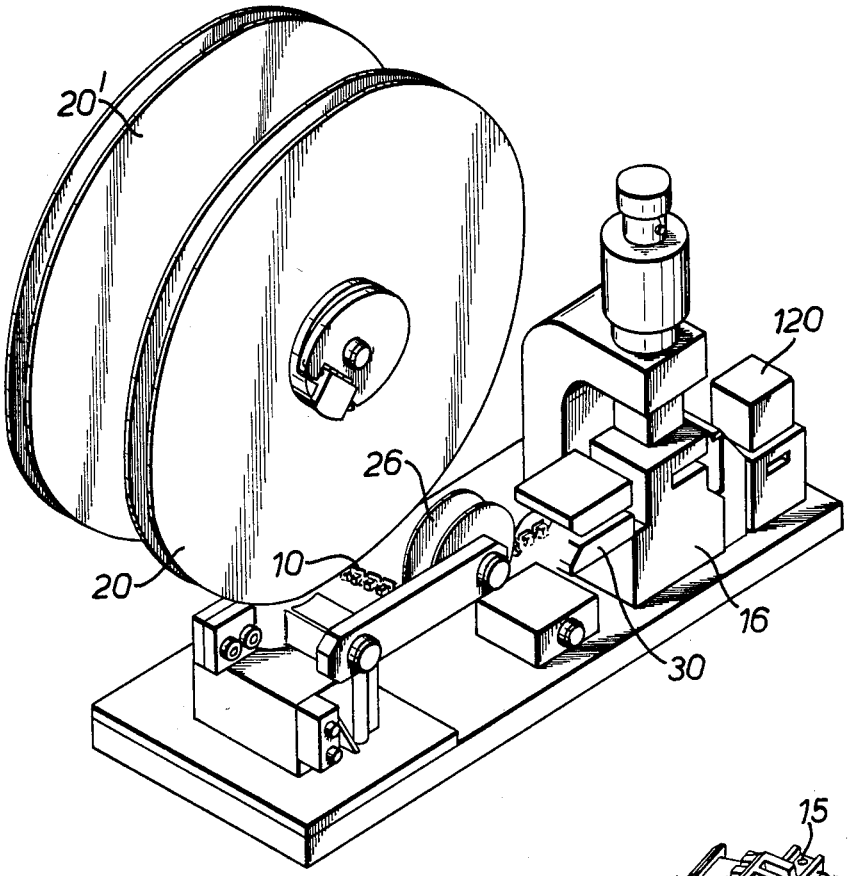
FIG. 1 shows a semi-automatic machine for a discrete wire assembly, supplied with reels of connectors according to this invention connected in a chain.
Figure 2:
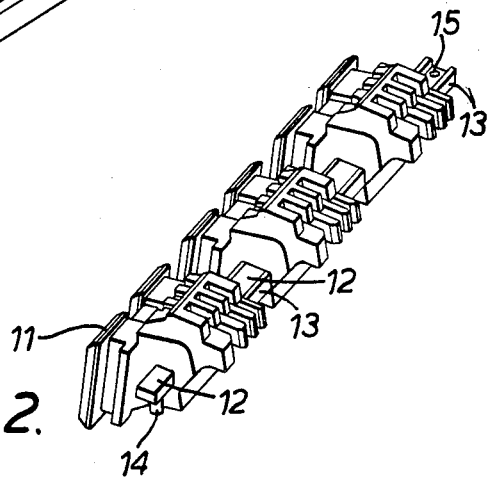
FIG. 2 shows three identical connector housings according to this invention, the housings being interconnected with one another in a line.
Figure 6:
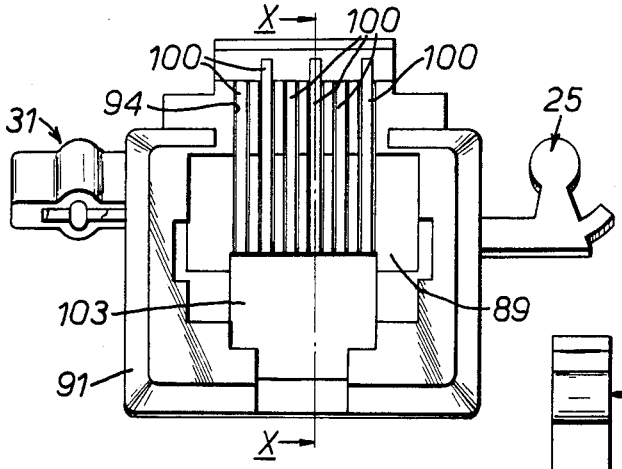
FIG. 6 is a front view of the connector shown in FIG. 5.
Figure 7:
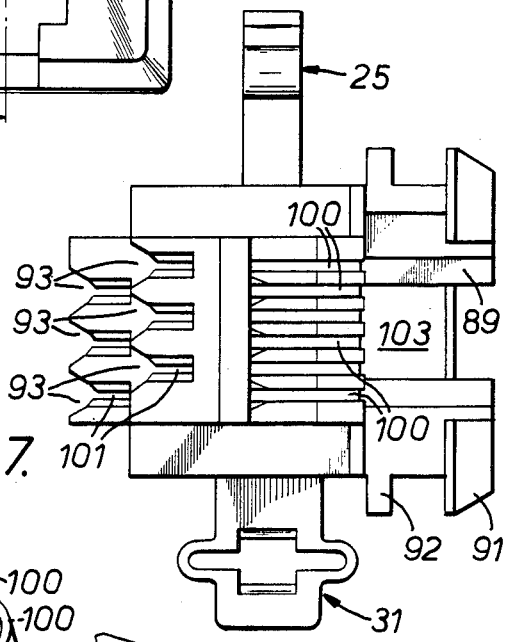
FIG. 7 is a plan view of the connector shown in FIG. 6.

With reference now to the accompanying drawings, the machine shown in FIG. 1 is for assembling terminated wires into connectors 10 at an insertion station 16. The connectors 10 have housings 11 (see FIG. 2) provided with complementary coupling formations 12 and 13, one on each of an opposite pair of sides of the housing. The formations 12 and 13 are formed respectively with a pin 14 and a hole 15 capable of receiving the pin such that the connector housings 11, and therefore the connectors 10, may be interconnected in a line in side-by-side sequence, as shown in FIG. 2. As shown in that figure, the formations 12 are otherwise drawbar-like having a rectangular cross-sectional shape and the formations 13 are of drawbar-like channel form to receive the bar-like formations 12 between the side walls of the channels so that the inter-engaging formations 12 and 13 align the connectors 10 with each connector similarly orientated in the line.

The pins 14 of the interconnected formations 12 and 13 provide for a flexible connection between each adjacent pair of the connectors 10 in the line and this enables a long line of the connectors 10 to be wound on a reel 20 for transportation and storage and for subsequent use in an assembling machine such as shown in FIG. 1. The pin-and-hole connections 14, 15 are readily disconnectible and reconnectible so that a fresh line of the connectors 10 or a fresh line of different connectors having the same formations 12 and 13, may readily be attached to the end of a line of connectors 10 being fed forward by a feed unit 30 of the machine after interchanging the reel 20 with a further reel 20' on which the fresh line of connectors has been wound.

Since the connectors 10 are all similarly orientated in the line and may be wound on a reel between the reel flanges with the connectors all held in the same relative orientation with respect to one another, it is necessary only to guide the line of connectors 10 into the feed unit 30 in order to present each connector in a required orientation with respect thereto and this may be achieved quite simply by using one or more flanged guide rollers 26 for the line of connectors being fed from the reel 20.

Referring now to FIGS. 3 and 4, these show a connector housing 28 similar to housings 11 shown in FIG. 2 but having a modified form of complementary coupling formations 25 and 31 replacing the formations 12 and 13.

These formations 25 and 31 are again drawbar-like and still provide a pin-and-hole connection, but in this case the function of aligning the housings 28 when interconnected in a line is assigned to the pins 32 and holes 34. Furthermore, each pin 32 is disposed at the outboard edge of its formation 25 and has a part-cylindrical head 36 which is journalled in a part-cylindrical portion 38 of the hole, a shank 37 which is a clearance fit in the hole to provide for articulation between each pair of housings 28 interconnected by their pin and hole connections, the head 36 being a snap fit in the hole 34 to seat in the hole portion 38, and a part hollow cylindrically shaped stop finger 39. As best seen in FIG. 3, the pin has an opposite pair of longitudinally extending plane parallel side surfaces 40 which extend to the head 36 and to the finger 39 and these side surfaces 40 then lie in flat face to face engagement respectively with an opposite pair of plane longitudinally extending parallel side surfaces 42 of the formation 31 which extend to the hole 34 and to a recess 33 at the inboard side of the hole to align the interconnected housings as required. The hole 34 has a converging lead-in portion 50 for the pin head 36 bounded on a further pair of opposite sides by flat surface portions 54 and 56 disposed in planes perpendicular to the planes of the surfaces 42 and at an angle of 15 degrees and 25 degrees respectively with respect to the longitudinal axis 60 of the hole. The surface portion 54 is disposed at the outboard side of the hole 34 and the surface 56 is disposed at the inboard side of the hole and on the end of a part hollow cylindrically shaped guide finger 35. The shank 37 of the pin 32 is bounded on a further pair of opposite sides by flat surface portions 62 and 64 disposed in planes perpendicular to the planes of the surfaces 40 and at angles of 8 degrees and 10 degrees respectively with respect to the longitudinal axis 66 of the pin. The surface portion 62 is disposed at the outboard side of the pin and the flat surface portion 64 is disposed at the inboard side of the pin. When a pair of formations 25 and 31 are articulatingly interconnected, therefore, with the head 36 of the pin engaged in the part cylindrical portion 38 of the hole, with the side surfaces 40 of the pin engaged face to face with side surfaces 42 of the hole, and with the stop finger 39 entered into the recess 33 in engagement with the guide finger 35, the pin and hole surface portions 62 and 56 confront one another and likewise the pin and hole surface portions 64 and 54. The respective angular dispositions of these confronting surface portions 62 and 56 and 64 and 54 provide clearance for articulation in the interconnection or joint about substantially a single axis coincident with the cylindrical axis of the head 36. In one direction of hinging, the adjacent bottom edges 70 of confronting flange side faces 71 of the housings 28 are swung towards one another from a position in which these side faces are parallel and the longitudinal axes 60 and 66 of the hole and pin are coincident. The clearance for this hinging movement is provided by the respective relative angular dispositions of the surface portions 62 and 56 which make an angle of 17 degrees. For the opposite direction of hinging the clearance is 5 degrees measured between the respective angular dispositions of the surface portions 64 and 54. This angle is not significant and may be reduced to zero or increased as desired.

The housings 28 are intended to be all similarly interconnected, side to side in a line, in the orientation shown in FIG. 4*a* and to be wound on a reel, such as 20, with the bottom edges of their adjacent pairs of flange side faces 71 disposed radially innermost of the edges of those flange side faces. The extent of the hinging movement to permit reeling of the interconnected housings in this fashion is determined by the end faces 80 of the stop fingers 39 engaging the floors 81 of the recesses 33 and in the present embodiment the housings 28 are capable of being reeled at a minimum radius of about 6 cm. In the interconnected condition of the housings, the guide fingers 35 are trapped between the pin heads 36 and the stop fingers 39 and assist in maintaining the interconnections between adjacent housings. The stop fingers 39 and the guide fingers 35 engage one another respectively at radially inner and radially outer part cylindrical surfaces 84 and 85. The cylindrical axes of surfaces 84, 85 are coincident with the axis 86 of the pin head 36 and the axis 87 of the part cylindrical hole portion 38, respectively, to provide further surface bearing support accommodating the articulation in the joints.

Each housing 28, like the housings 11, is formed as a moulding of dielectric material. In order to provide the necessary flexibility to allow a pin head 36 to be snap fitted into the hole 34 of a further housing, if this is not provided by the material itself, the formation 31 may be provided with a transverse slot 96 seen best in FIG. 3 intersecting the hole and being defined by relatively thin and, therefore, relatively more flexible webs 97 of the material of the housing which allow the hole 34 to expand in the longitudinal direction of the formation 31 to pass a pin head 36 through the throat 90 of the hole.

It is not essential that the pin and hole connections from closely interfitting joints. Some looseness in these joints is permissible provided that the joints hold the housings substantially in line.

The guide fingers 35 and the stop fingers 39 may be idspensed with if desired.

The connector housings 11 and 28 are otherwise formed as plug sockets having a hollow body 89 with mounting flanges 91 and 92 at its front end. The four-position housing seen in FIGS. 3, 4 and 5 has at its back end, two tiers of two terminated wire receiving slots 93 and four terminal locating grooves 94 for terminals, one to be associated with each wire receiving slot 93.

The alternative arrangement of FIG. 4*b*, is substantially similar to that of FIG. 4*a*, but for a modified female socket arrangement or formation 31*a* and like elements are referenced alike, as in FIG. 4*a*. As can be seen in FIG. 4*b*, formation 31*a* has a hole 134 formed therein, defined by substantially flat side walls 154*a*, 154*b*. Formation 31*a* includes opposed, inwardly projecting finger-like resilient members 160, 162 having free ends 164, 166, respectively. Members 164, 166 form resilient camming surfaces that receive head 36 of an adjacent housing member, with a snap fit. That is, the throat 170 formed between opposed free ends 164, 166 is dimensioned slightly smaller than the width of head 36. Due to their relatively thin cross-sectional dimension, and/or material composition, finger-like projections 164, 166 are resilient, being deflected to accommodate the passage of head 36 therebetween. Thereafter, head 36 is held captive by members 164, 166 so as to form a journalled pivotable coupling between adjacent housing members.

Figure 8:
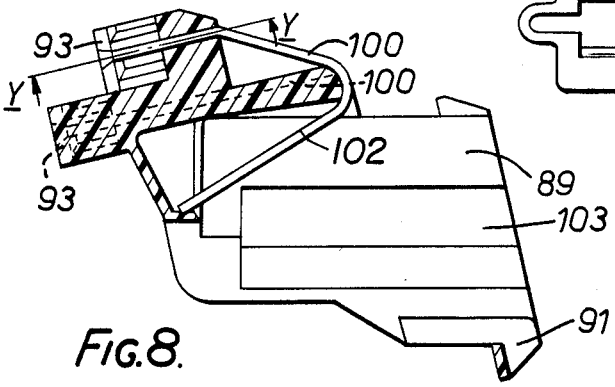
FIG. 8 is a cross-section on line X—X in FIG. 6.
Figure 9:
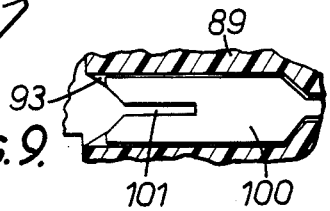
FIG. 9 is a cross-section on line Y—Y in FIG. 8.

The arrangement of the terminals themselves will be understood from a consideration of FIGS. 5 to 9 where two tiers of three slots 93 are provided and six terminal locating grooves 94. The terminals 100 are in this case illustrated and each is of U-strip form (as best seen in FIG. 8) having a terminated wire receiving slot 101 opening at one end and positioned in a housing slot 93, and a limb 102 extending into the hollow interior 103 of the body 89 of the housing (as best seen in FIG. 8) to make electrical contact with a terminal of a plug connector inserted into the hollow body.

The machine illustrated in FIG. 1 has the function of assembling terminated wires into the slots 93 and 101 for which purpose the connector housings 11 or 28 are orientated between the vertical flanges of the reel 20 with front and rear end faces 110 and 111 (see FIG. 5) disposed vertically, flat against the flange faces, and likewise the longitudinal axes of the pins 14 or 32 and the holes 15 or 34. After assembly, the formations 12 and 13 or 31 are cropped by a chain cropping device 120 and the harnesses are discharged from the machine.

In an alternative machine the terminals 100 are inserted in the housings 11 or 28 with the housings being fed from a reel 20 into the machine, the chain of connectors assembled in the machine being re-reeled on a further reel 20 for storage and transport purposes.

I claim:

1. An arrangement for carrying a continuous sequence of a plurality of similarly oriented housing members, each having oppositely facing first and second sides, said housing members being adapted to be connected together in side-by-side relationship so that the first side of one housing member is next to the second side of the adjacent housing member, wherein the improvement comprises:

an integral first support arm extending from the first side including a male pivotal coupling member at the free end thereof;

an integral second support arm extending from the second side including a female pivotal coupling member having a complementary shape with respect to said male coupling member and adapted to receive and engage the male coupling member of an adjacent housing to provide a pivotal coupling between adjacent first and second housings; and limit means integrally formed with said male and female pivotal coupling members for restricting the pivotal movement between adjacent coupled housings while maintaining engagement of said pivotal coupling members.

2. The arrangement of claim 1 wherein said male coupling member comprises a pin extending transverse to said first support arm adjacent said free end thereof, and said female coupling member includes a pin receiving hole.

3. The arrangement of claim 1 wherein said male coupling member includes a cylindrical pivot head and said female coupling member includes socket means whereby a male coupling member of an adjacent housing is journalled and is held captive therein with a snap fit.

4. The arrangement of claim 3 wherein said female coupling member includes first and second opposed spaced apart wall surfaces each having resilient camming surfaces for engagement with opposed spaced apart cylindrical portions of said pivot head.

5. The arrangement of claim 4 wherein said limit means comprises:

a trapezoidal shank member having a pair of opposed inclined surface portions, and a pair of opposed parallel portions disposed between said cylindrical pivot head and said first support arm; and said female socket means includes an opening formed by two opposed entrance wall portions of said second support arm, said wall portions including said resilient camming surfaces, said cylindrical pivot head being received in said opening so as to engage said camming surfaces for a snap fit coupling engagement with said second support arm;

whereby rotation of said cylindrical pivot head in said socket means being limited by engagement of said inclined surface portions of said first support arm with said entrance wall portions of said second support arm.

6. The arrangement of claim 4 wherein said limit means further comprises and outwardly extending finger member having a free end and located adjacent said free end of said first support arm, and wherein relative pivotal movement between intercoupled first and second housing members is limited by engagement of said free end of said finger member with a second support arm of said second housing member.

* * * * *